US012467718B2

(12) United States Patent
Miu

(10) Patent No.: US 12,467,718 B2
(45) Date of Patent: Nov. 11, 2025

(54) FAST ZERO ADJUSTING TURRET FOR RIFLE SCOPE

(71) Applicant: MIAO OPTICS CO., LTD, Nantong (CN)

(72) Inventor: Xiaolin Miu, Nantong (CN)

(73) Assignee: MIAO OPTICS CO., LTD, Nantong (CN)

( * ) Notice: Subject to any disclaimer, the term of this patent is extended or adjusted under 35 U.S.C. 154(b) by 383 days.

(21) Appl. No.: 18/220,939

(22) Filed: Jul. 12, 2023

(65) Prior Publication Data

US 2025/0012545 A1 Jan. 9, 2025

Related U.S. Application Data

(63) Continuation of application No. PCT/CN2022/105476, filed on Jul. 13, 2022.

(51) Int. Cl.
*F41G 1/38* (2006.01)

(52) U.S. Cl.
CPC ..... *F41G 1/38* (2013.01)

(58) Field of Classification Search
None
See application file for complete search history.

(56) References Cited

U.S. PATENT DOCUMENTS

| | | | | |
|---|---|---|---|---|
| 5,174,772 | A | 12/1992 | Vranish | |
| 2018/0347945 | A1* | 12/2018 | Burianec | F41G 1/42 |
| 2019/0072363 | A1* | 3/2019 | Kilic | F41G 1/46 |

FOREIGN PATENT DOCUMENTS

| | | | |
|---|---|---|---|
| CN | 106288955 | A | 1/2017 |
| CN | 207317636 | U | 5/2018 |
| CN | 113654401 | A | 11/2021 |
| CN | 215893413 | U | 2/2022 |
| GB | 224433 | A | 11/1924 |
| GB | 395308 | A | 7/1933 |

* cited by examiner

*Primary Examiner* — Richard H Kim
(74) *Attorney, Agent, or Firm* — Birchwood IP

(57) ABSTRACT

The invention disclosure relates to a fast zero adjusting turret for rifle scope, comprising an turret base, an adjusting knob is movably installed on the turret base, a central tube is vertically arranged through the middle of the bottom surface of the turret base, a spline screw is arranged in the central tube, a spline dial is arranged therein, a storing tube protrudes upward from the top surface of the spline dial, a limit cam is further arranged inside the turret base, a height groove is opened on the top surface of the limit cam, a turn indicator is adhered to the top surface of the limit cam, a top reset spring is movably installed on the turn indicator. The operator can intuitively know the number of turns of rotation and improve shooting calibration time by observing the rise and fall of the turn indicator.

8 Claims, 9 Drawing Sheets

FAST ZERO ADJUSTING TURRET FOR RIFLE SCOPE

CROSS-REFERENCE TO RELATED APPLICATIONS

The present application is a 35 U.S.C. § 371 National Phase conversion of International (PCT) Patent Application No. PCT/CN2022/105476 filed Jul. 13, 2022, the contents of all of which are hereby incorporated by reference.

TECHNICAL FIELD

The present disclosure relates to the technical field of adjusting turret for rifle scope, in particular to a fast zero adjusting turret for rifle scope.

BACKGROUND

Optical sights for projectile weapons, such as guns, may need to be adjusted when aiming at an object. For example, a rifle scope can be adjusted vertically and/or horizontally to compensate for possible fall of a bullet during its flight or change in its course due to environmental factors, and to increase the likelihood that an object positioned at the intersection of crosshairs of the rifle scope could be hit by a bullet. The vertical adjustment of rifle scope is altitude adjustment since it compensates for change in altitude of bullets (e.g. falling), and the horizontal adjustment of rifle scope is wind direction adjustment since it compensates for sideway movement of bullets, which is usually caused by wind.

Rifle scope can be horizontally and vertically adjusted by manually rotating the knob on them. These rotary knobs can be used to adjust the position of lenses or other optical elements in the rifle scope. The indicator scale consisting of a set of marks on the outside of knobs visually indicates the amount of rotation of the knobs. For some adjustment knobs, the position of the indicator scale can be adjusted relative to that of the knobs. The operation is as follows: loosen the flat head screws connecting the dial of the knob with the rotatable threaded parts inside the knob using a hex wrench, rotate the dial to the desired position to set the zero of the knob, then re-tighten the screws to secure the dial to the threaded parts to allow them to rotate together. In this way, the elevation and/or windage knob can be "zeroed" to ensure the shooter correctly calibrates (or "aims") the rifle scope to aim the gun at an object at a certain distance. Therefore, rifle scope aiming at a known distance contributes to accurate aiming adjustments relative to calibration settings at other distances or environmental conditions.

However, the above adjustment scheme still has the following problems:

1. Failure to return to zero quickly;
2. Failure to allow operator to remember the number of turns of rotation of knob in an intuitive and accurate way;
3. Longer time in shooting correction.

Therefore, the present application proposes a fast zero adjusting turret for rifle scope to solve the above problems.

SUMMARY

In view of the shortcomings of the prior art, the present disclosure provides a fast zero adjusting turret for rifle scope. The fast zero adjusting turret for rifle scope is different from conventional adjusting turret, and the adjusting knob can be quickly zeroed and stopped without using a tool. The operator can quickly zero the adjusting turret and obtain a perceptible hand feeling at the same time due to the countersunk hole design. In addition, the operator can intuitively know the number of turns of rotation and improve the shooting correction time by observing the rise and fall of the color cap.

In order to achieve the above purpose, the present disclosure provides the following technical solutions: a fast zero adjusting turret for rifle scope, comprising the turret base fixed on the rifle scope, the rotatable adjusting knob movably installed on the turret base, the central tube vertically penetrating the middle of the bottom surface of the turret base, and the spline screw that can move up and down the central axis thereof;

the spline dial that can rotate with the adjusting knob is arranged therein, the storing tube splinedly connected to the spline screw protrudes upward from the top surface of the spline dial, and threads connected to the spline screw are arranged on the inner peripheral wall of the central tube, the limit cam fixed relatively to the turret base and located above the spline dial is further arranged inside the turret base, the height groove is opened on the top surface of the limit cam, the height groove is in spiral shape with multiple spiral turns, and the height of the height groove with multiple spiral turns is decreased by an equal amount from inside to outside, the countersunk hole opened on the limit cam is connected to the bottom surface at the inner end of the height groove, the turn indicator is adhered to the top surface of the limit cam, the top end of which penetrates and extends to the top surface of the adjusting knob, the top reset spring is movably installed on the turn indicator, on the bottom surface with eccentricity of which the eccentric rod extending its bottom end to the height groove and arranged in the countersunk hole is vertically fixed.

Further, the bottom of the eccentric rod is in are shape and arranged in the countersunk hole, the color cap is fixed on the top of the Eccentric float (turn indicator); when the eccentric rod is arranged in the countersunk hole, the top surface of the color cap is on the same plane as that of the adjusting knob.

Further, the butt gear ring is vertically fixed on the top surface of the spline dial, the butt ring is vertically fixed on the inner top wall of the adjusting knob, and the annular gear groove engaged with the butt gear ring is opened on the outer peripheral wall of the butt ring.

Further, the cylindrical groove is opened on the outer peripheral wall of the spline dial, the cylindrical groove is in T shape, in which the abutting part that can linearly move along its central axis is arranged; the abutting part comprises the slender rod, the thick rod and the abutting head; the abutting head is fixed in T shape at one end of the thick rod and inserted into the T-shaped cylindrical groove; the slender rod located in the cylindrical groove is fixed at the other end of the thick rod, the bottom reset spring is movably installed on the slender rod, the outer wall of the thick rod fits the inner wall of the cylindrical groove, the annular abutting gear groove is opened on the inner peripheral wall of the turret base, one side of the abutting head away from the thick rod is in conical shape, and the conical portion of the abutting head is arranged in the annular abutting gear groove.

Further, the dial pressing ring is arranged between the limit cam and the inner wall of the turret base, the mounting ring is fixed on the outer peripheral wall and close to the top surface of the dial pressing ring, threads are arranged on the outer peripheral wall of the dial pressing ring, the first threaded groove threadedly connected to the outer peripheral wall of the dial pressing ring is opened on the inner peripheral wall of the turret base, a plurality of mounting holes are opened on the mounting ring, the fixing screws that can be screwed through the bottom end of the mounting holes and extended into the dial pressing ring are arranged in the mounting holes, the second threaded groove for inserting the fixing screws and threadedly connecting thereto is opened on the top surface of the turret base, the brake gear ring is vertically fixed on the bottom surface of the limit cam, and the brake gear groove that can be engaged with the brake gear ring is opened on the inner peripheral wall of the dial pressing ring.

Further, the annular limit gear groove is opened on the outer peripheral wall of the turret base, and the limit gear ring engaged with the annular limit gear groove is fixed on the inner peripheral wall of the adjusting knob.

Further, the locking screw is arranged through the top surface of the adjusting knob into the butt ring and fits the inner wall of the butt ring, the top surface of the adjusting knob is on the same plane as that of the locking screw, the connecting tube is fixed on the top surface of the storing tube, threads are arranged on the outer peripheral wall of the connecting tube, the third threaded groove threadedly connected to the outer peripheral wall of the connecting tube is opened on the inner peripheral wall of the locking screw, the annular storing groove is opened on the outer peripheral wall of the locking screw, the rubber clamp ring is installed in the annular storing groove, two annular clamp grooves distributed up and down are opened on the inner peripheral wall of the butt ring, and the outer side of the rubber clamp ring is arranged in the annular clamp groove.

Further, the boss pressing ring is threadedly connected to the inner peripheral wall of the adjusting knob, threads are arranged on the outer peripheral wall of the boss pressing ring, the fourth threaded groove threadedly connected to the outer peripheral wall of the boss pressing ring is opened on the inner peripheral wall of the adjusting knob, the annular limit groove is opened on the outer peripheral wall of the limit cam, the boss pressing ring is arranged in the annular limit groove and fits the gap thereof, and the annular limit groove extends to the bottom surface of the limit cam.

Compared with the prior art, the present disclosure has the following beneficial effects:

Different from conventional adjusting turret, the operator can intuitively know the number of turns of rotation of the fast zero adjusting turret for rifle scope by observing the rise and fall of the color cap thereon. In addition, the operator can quickly rotate the adjusting knob for "zeroing" it as required since the countersink hole is opened at the starting end of the limit cam. When rotating it to match the eccentric rod with the countersunk hole, the eccentric rod can be inserted into the countersunk hole under the tension of the top reset spring, so the operator can get a perceptible hand feeling for quickly rotating the adjusting knob for "zeroing" it and improve the shooting calibration time.

Figure 1:
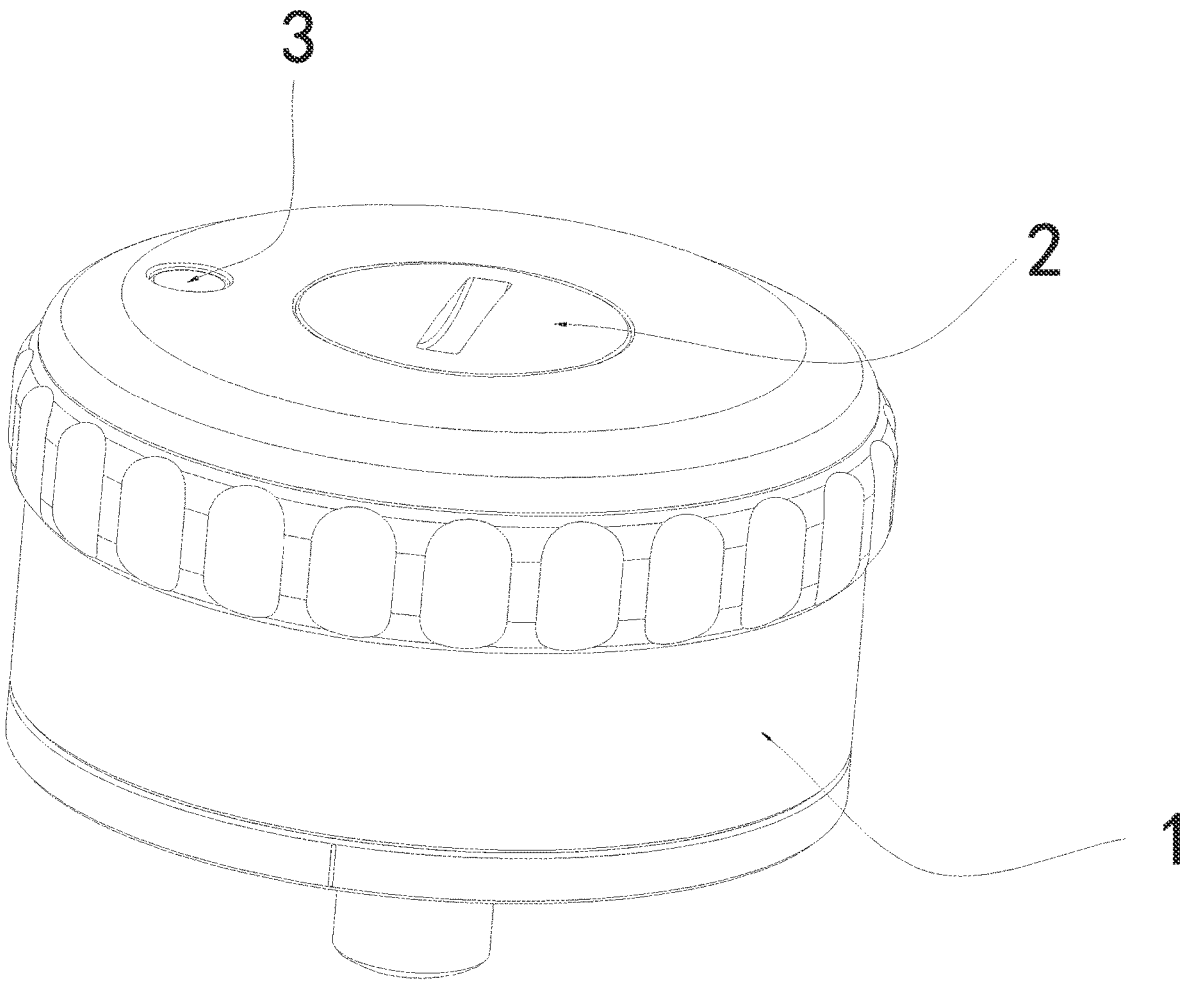
FIG. 1 is a schematic diagram of the structure in the present disclosure.

Description of the Reference Numerals: 1. adjusting knob; 2. locking screw; 3. turn indicator; 4. turret base; 5. Central tube; 6. Spline screw; 7. Spline dial; 8. Storing tube; 9. Connecting tube; 10. Top reset spring; 11. Eccentric rod; 12. Rubber clamp ring; 13. Annular clamp groove; 14. Butt ring; 15. Butt gear ring; 16. Annular gear groove; 17. Cylindrical groove; 18. Abutting part; 19. Bottom reset spring; 20. Limit gear ring; 21. Boss pressing ring; 22. Limit groove; 23. Brake gear ring; 24. Annular abutting gear groove; 25. Dial pressing ring; 26. Fixing screw; 27. Mounting ring; 28. Annular limit gear groove; 29. Limit cam; 30. Countersunk hole; 31. Brake gear groove.

DETAILED DESCRIPTION

The technical solutions provided in the embodiment of the present disclosure will be described clearly and completely below in accordance with the drawings in the embodiments of the present disclosure. Apparently, the described embodiments are merely a part rather than all of the embodiments of the present disclosure. All other embodiments made by those of ordinary skill in the art based on the embodiment of the present disclosure without creative work shall fall within the protection scope of the present disclosure.

Figure 2:
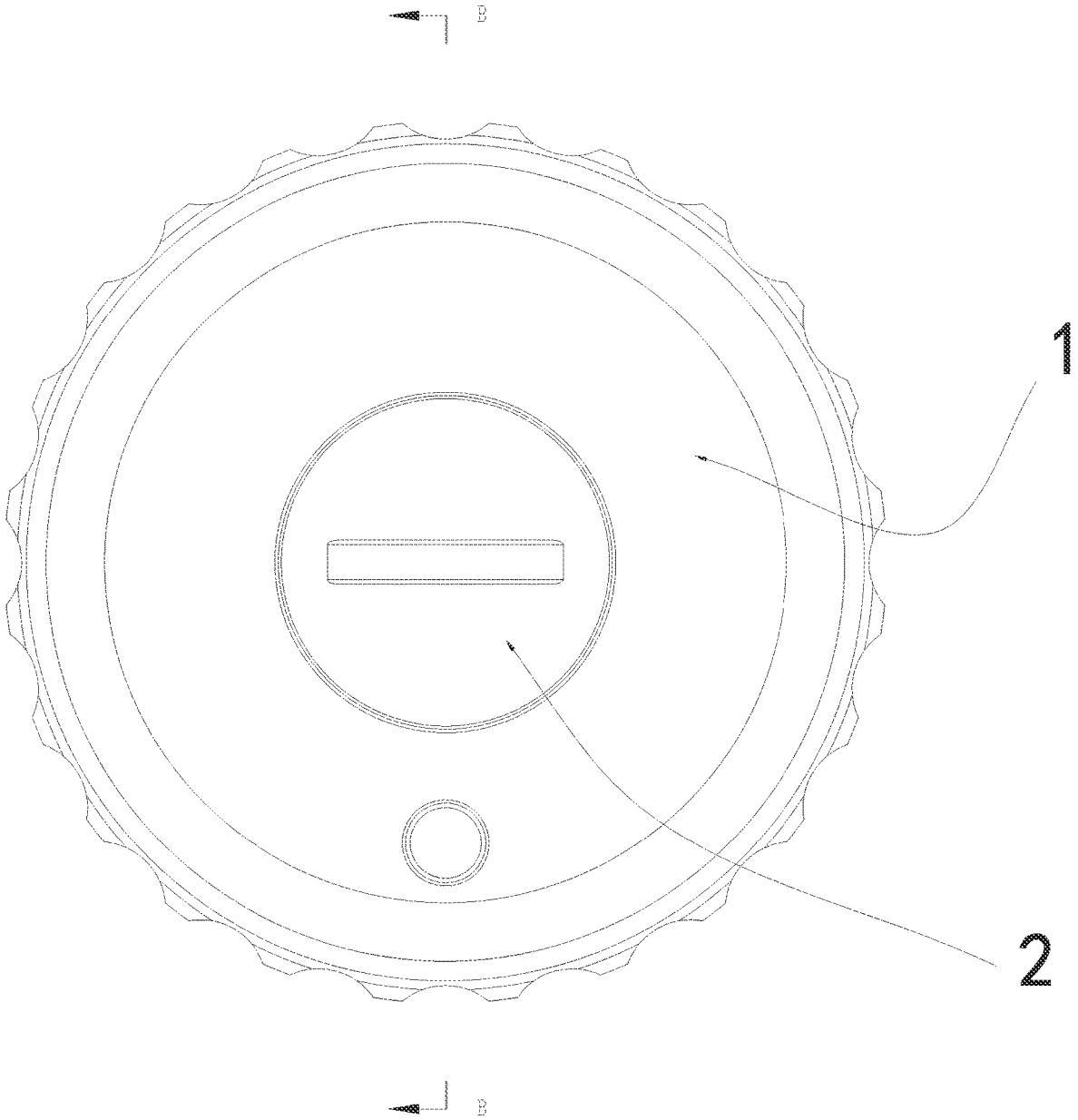
FIG. 2 is a structural schematic diagram (top view) of the adjusting knob in the present disclosure.
Figure 3:
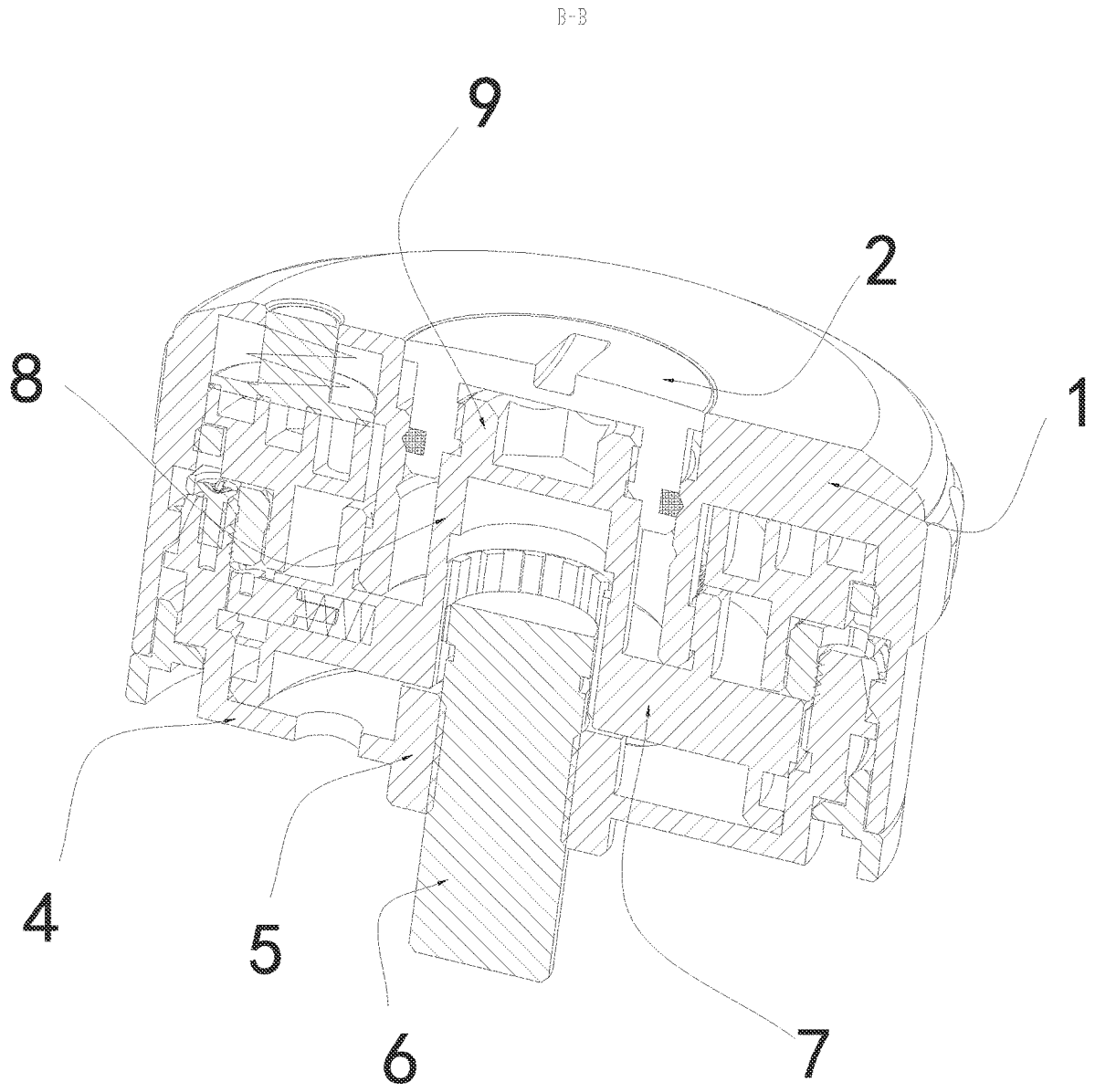
FIG. 3 is a schematic diagram (section view) of the structure in the present disclosure.
Figure 4:
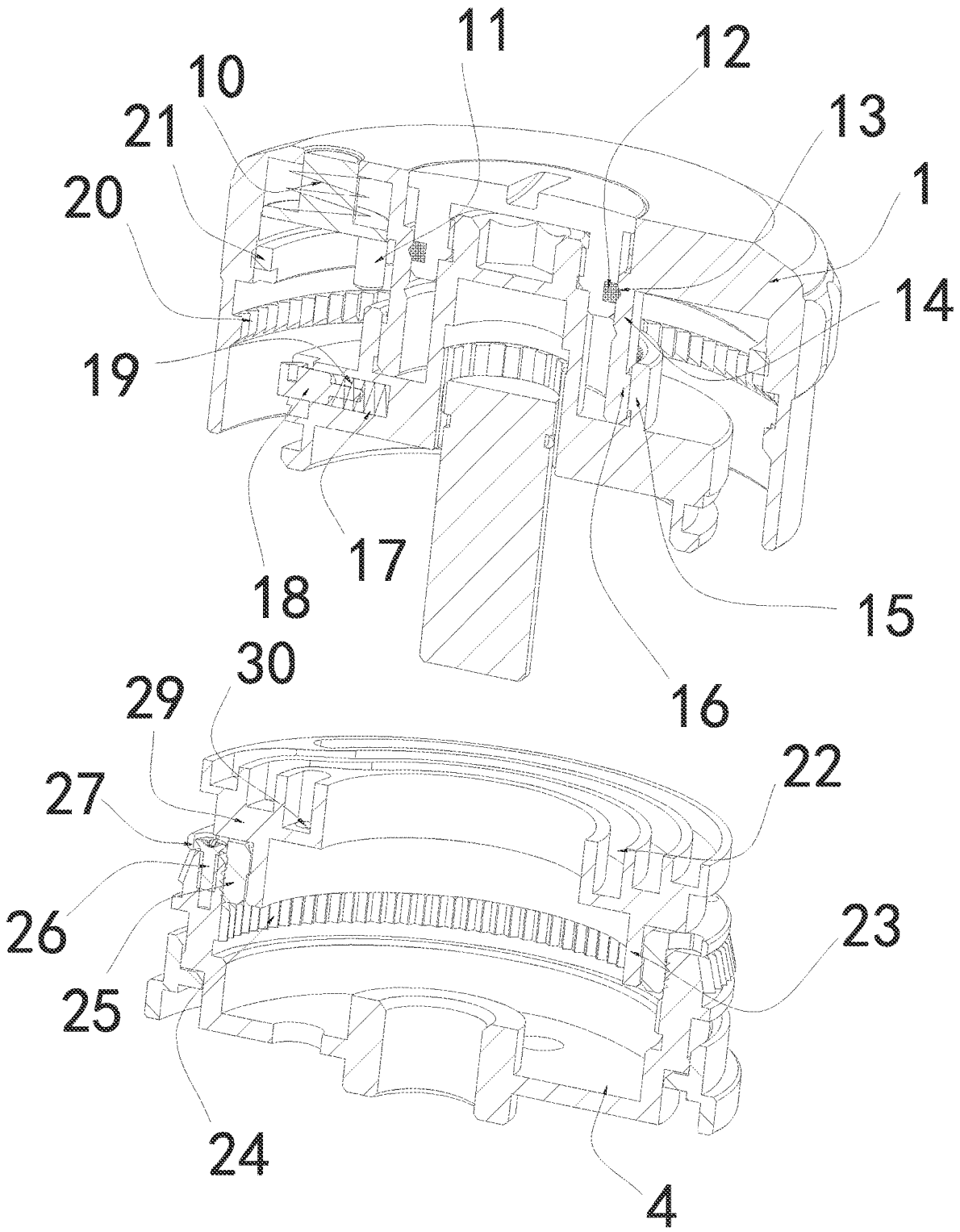
FIG. 4 is an explosive diagram of the structure in FIG. 3 of the present disclosure.
Figure 5:
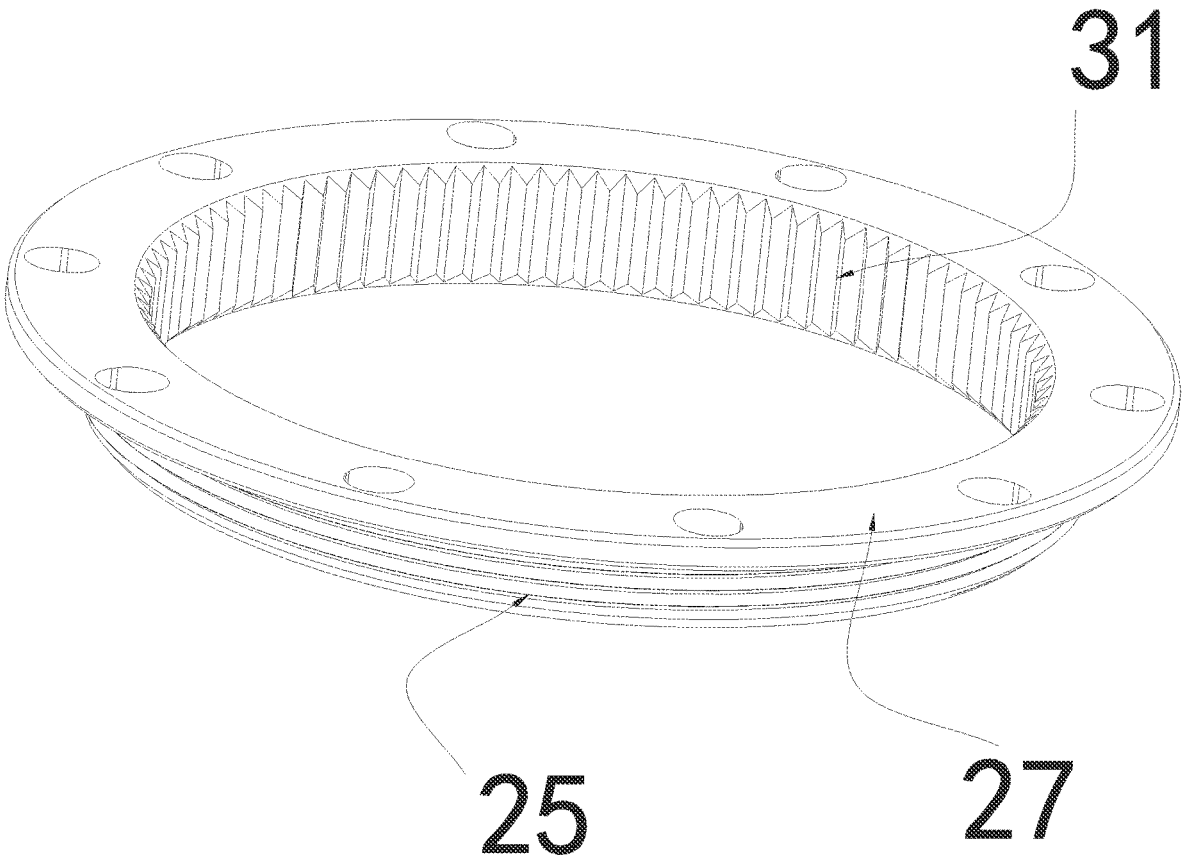
FIG. 5 is a structural schematic diagram of the dial pressing ring in the present disclosure.
Figure 6:
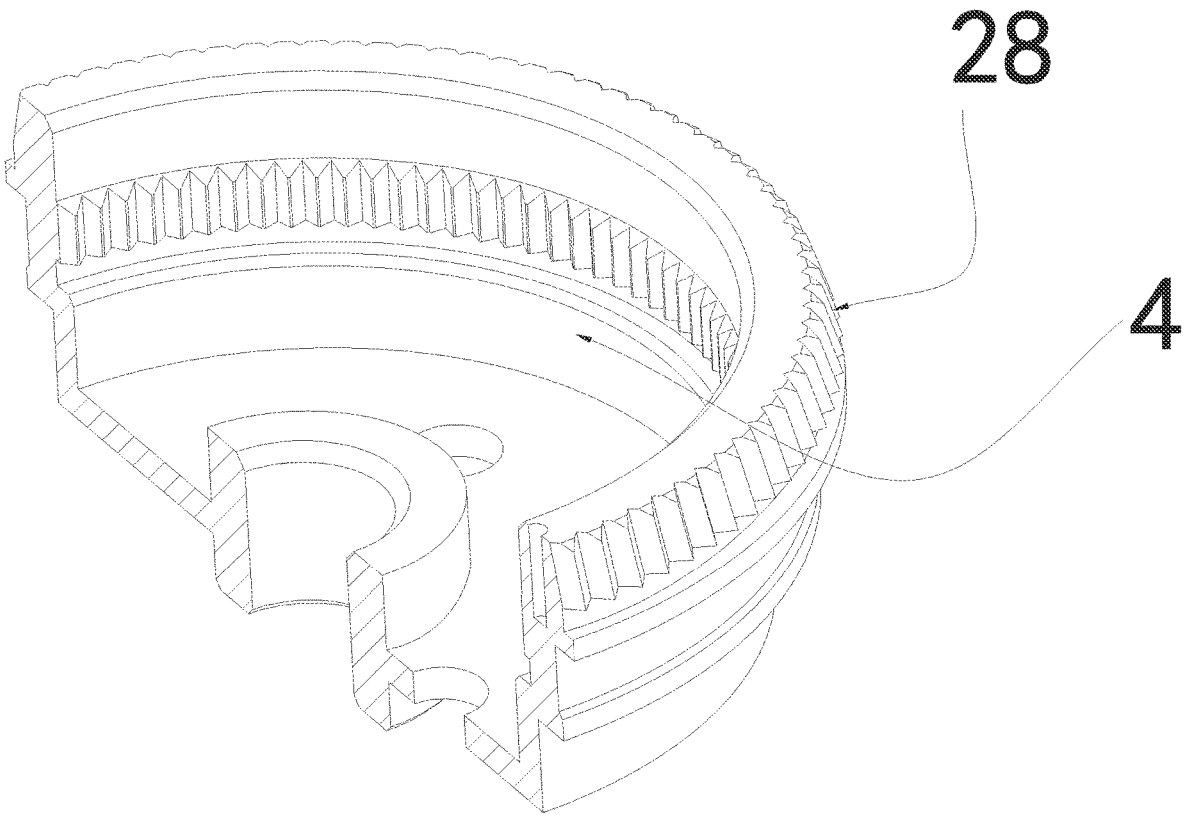
FIG. 6 is a structural schematic diagram (section view) of the turret base in the present disclosure.
Figure 7:
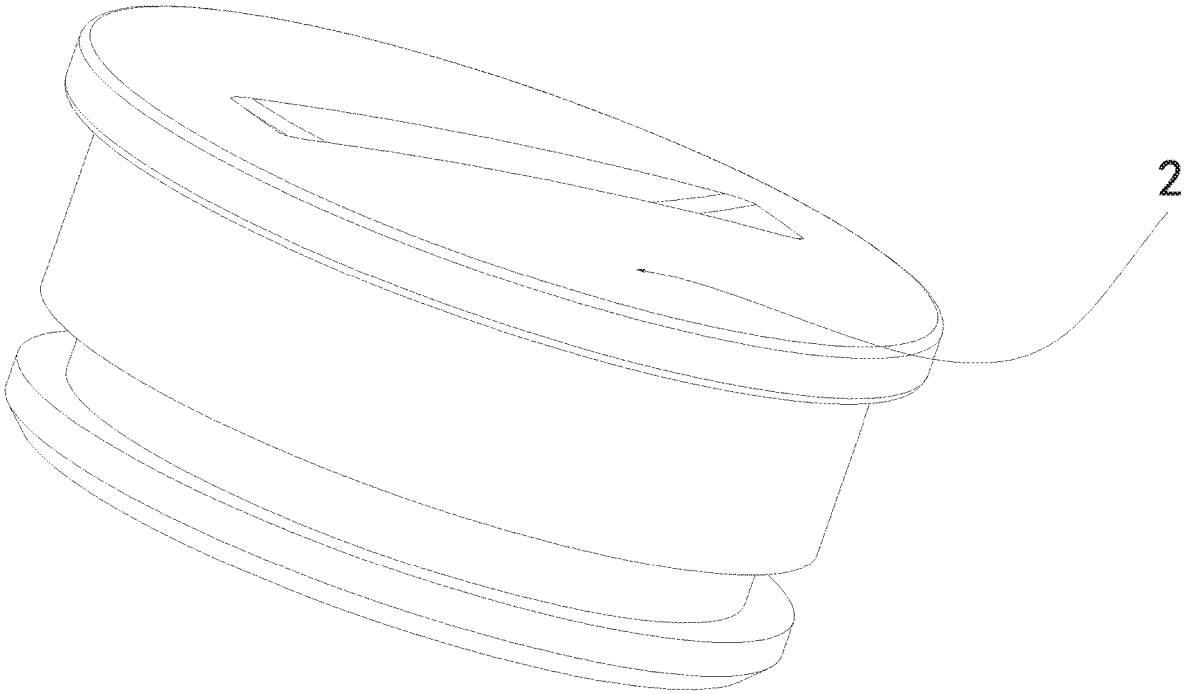
FIG. 7 is a structural schematic diagram of the locking screw in the present disclosure.
Figure 8:
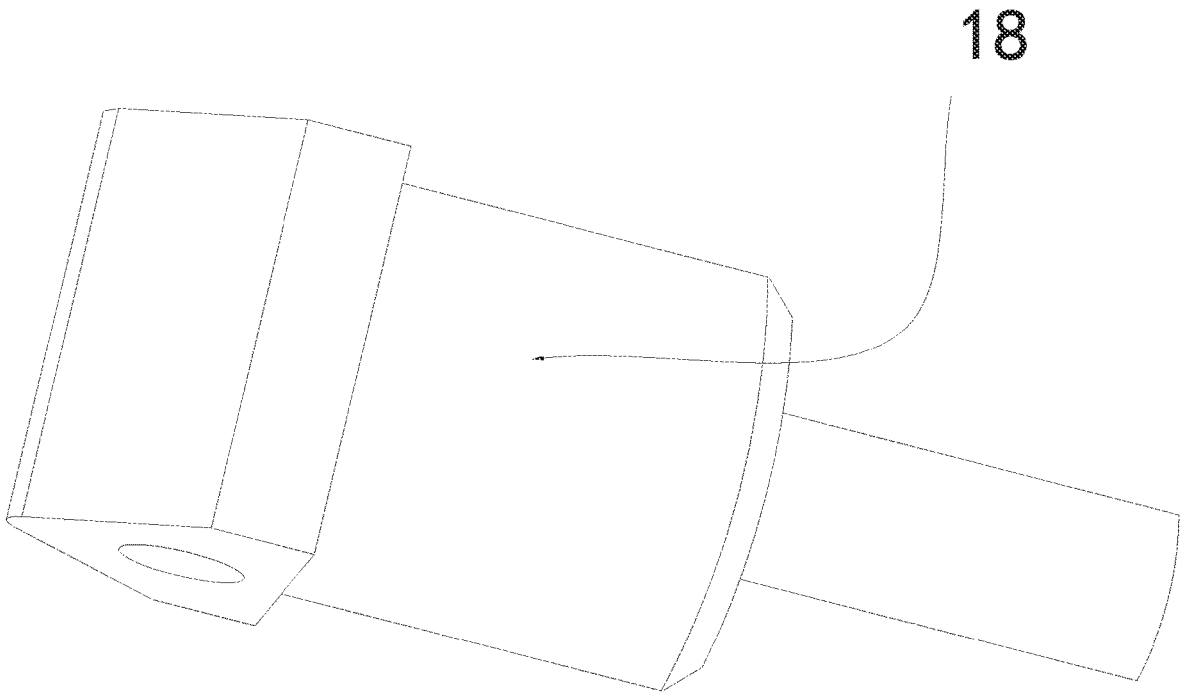
FIG. 8 is a structural schematic diagram of the abutting part in the present disclosure.
Figure 9:
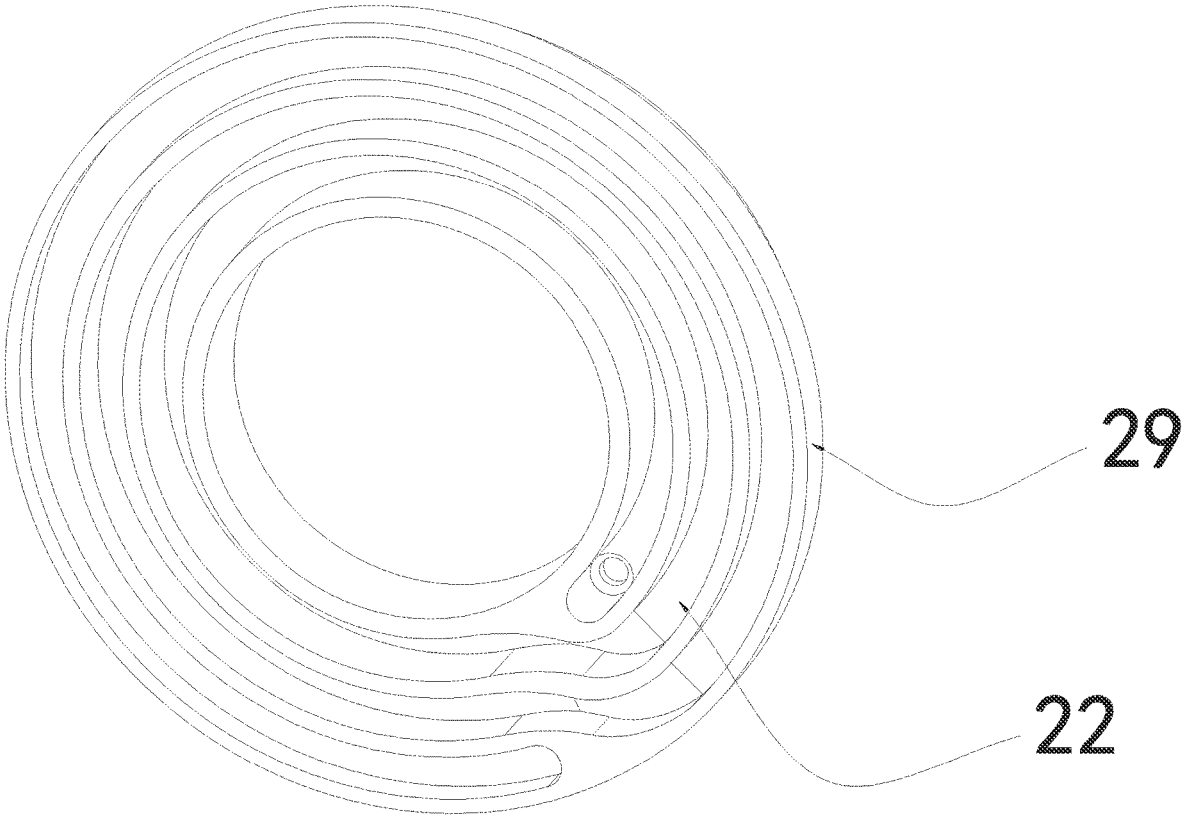
FIG. 9 is a structural schematic diagram of the limit cam in the present disclosure.

Referring to FIGS. 1-9, the fast zero adjusting turret for rifle scope in the present disclosure, comprising the turret base 4 fixed on the rifle scope, the rotatable adjusting knob movably installed on the turret base 4, the central tube 5 vertically penetrating the middle of the bottom surface of the turretbase 4, the spline screw 6 that can move up and down the central axis of the central tube; by rotating the adjusting knob 1, the spline screw 6 is moved up and down for achieving the purpose of adjustment.

Specifically, the spline dial 7 that can rotate with the adjusting knob 1 is arranged therein, the storing tube 8 splinedly connected to the spline screw 6 protrudes upward from the top surface of the spline dial 7, and threads threadedly connected to the spline screw 6 are arranged on the inner peripheral wall of the central tube 5; when the adjusting knob 1 is rotated, it drives the spline dial 7 to rotate together, while the spline screw 6 can rotate with the spline dial 7 since the storing tube 8 is splinedly connected to the spline screw 6, and the spline screw 6 is threadedly connected to the central tube 5, so the spline screw 6 can move up and down to achieve the purpose of adjustment.

To allow the operator to clearly and intuitively know the number of turns of rotation of the adjusting knob 1 during the up and down movement of the spline screw 6 and easily understand the degree of adjustment, the limit cam 29 fixed relatively to the turret base 4 and located above the spline dial 7 is further arranged inside the turret base 4, the height groove 22 is opened on the top surface of the limit cam 29, the height groove 22 is in spiral shape with multiple spiral turns, and the height of the height groove 22 with multiple spiral turns is decreased by an equal amount from inside to outside; the countersunk hole 30 opened on the limit cam 29 is connected to the bottom surface at the inner end of the height groove 22, the turn indicator is adhered to the top surface of the limit cam 29, the top end of which penetrates and extends to the top surface of the adjusting knob 1, the top reset spring 10 is movably installed on the turn indicator, on the bottom surface with eccentricity of which the eccentric rod 11 extending its bottom end to the height groove 22 and arranged in the countersunk hole 30 is vertically fixed. The bottom of the eccentric rod 11 is in arc shape and arranged in the countersunk hole 30. The color cap is fixed on the top of the turn indicator, when the eccentric rod 11 is arranged in the countersunk hole 30, the top surface of the color cap is on the same plane as that of the adjusting knob 1. During operation, the adjusting knob 1 is rotated to drive the turn indicator 3 to move, so that the eccentric rod 11 below it moves in the height groove 22. As the limit cam 29 is stationary, so the turn indicator 3 slides along the height groove 22 of the limit cam 29. Because the height groove is in spiral shape with different heights, and the compressible top reset spring 10 is applied on the turn indicator 3, so that the turn indicator 3 slides along the height groove while moves up and down relative to the adjusting knob 1, which facilitates the operator to intuitively and clearly know the number of turns of rotation of the adjusting knob 1 by observing the rise and fall of the color cap. In addition, the operator can quickly rotate the adjusting knob for "zeroing" it as required since the countersunk hole 30 is opened at the starting end of the limit cam 29. When rotating it to match the eccentric rod 11 with the countersunk hole 30, the eccentric rod 11 can be inserted into the countersunk hole 30 under the tension of the top reset spring 10, so the operator can get a perceptible hand feeling while the top surface of the color cap is on the same plane as that of the adjusting knob 1 to facilitate the operator to quickly rotate the adjusting knob 1 for "zeroing" it.

It should be noted that, during the initial phase of rotation of the adjusting knob 1, the turn indicator 3 is subjected to a force due to the rotation of the adjusting knob 1, and the force is transmitted to the eccentric rod 11. As the bottom of the eccentric rod 11 is in arc shape and arranged in the countersunk hole 30, the arc-shaped bottom of the eccentric rod 11 can be moved upward and separated from the countersunk hole 30 due to the squeezing of the countersunk hole 30.

As for the rotation of the spline dial 7 with the adjusting knob 1, the butt gear ring 15 is vertically fixed on the top surface of the spline dial 7, the butt ring 14 is vertically fixed on the inner top wall of the adjusting knob 1, the annular gear groove 16 engaged with the butt gear ring 15 is opened on the outer peripheral wall of the butt ring 14, the spline dial 7 can be driven by the adjusting knob 1 to rotate due to the engagement of the annular gear groove 16 on the outer peripheral wall of the butt ring 14 with the butt gear ring 15. It should be noted that the spline dial 7 is arranged in the turret base 4, and the turret base 4 has a certain restrictive effect on the spline dial 7 to ensure its stability during rotation.

To allow the operator to get a better hand feeling when rotating the adjusting knob 1, the cylindrical groove 17 is opened on the outer peripheral wall of the spline dial 7, the cylindrical groove is in T shape, in which the abutting part 18 that can linearly move along its central axis is arranged; the abutting part 18 comprises the slender rod, the thick rod and the abutting head; the abutting head is fixed in T shape at one end of the thick rod and inserted into the T-shaped cylindrical groove 17; the slender rod located in the cylindrical groove 17 is fixed at the other end of the thick rod, the bottom reset spring 19 is movably installed on the slender rod, the outer wall of the thick rod fits the inner wall of the cylindrical groove 17, the annular abutting gear groove 24 is opened on the inner peripheral wall of the turret base 4, one side of the abutting head away from the thick rod is in conical shape, and the conical portion of the abutting head is arranged in the annular abutting gear groove 24. During the rotation of the spline dial 7, the annular abutting gear groove 24 opened on the inner peripheral wall of the turret base 4 squeezes the abutting head and drives it to move towards the cylindrical groove 17, so that the bottom reset spring 19 is compressed, the spline dial 7 continues to rotate, and the abutting head continues to abut the annular abutting gear groove 24 under the tension of the bottom reset spring 19, so a click sound can be produced abruptly, which helps the operator get a better hand feeling when rotating the adjusting knob 1.

As for the fixation between the limit cam 29 and the turret base 4, the dial pressing ring 25 is arranged between the limit cam 29 and the inner wall of the turret base 4, the mounting ring 27 is fixed on the outer peripheral wall and close to the top surface of the dial pressing ring 25, threads are arranged on the outer peripheral wall of the dial pressing ring 25, the first threaded groove threadedly connected to the outer peripheral wall of the dial pressing ring 25 is opened on the inner peripheral wall of the turret base 4, a plurality of mounting holes are opened on the mounting ring 27, fixing screws 26 that can be screwed through the bottom end of the mounting holes and extended into the dial pressing ring 25 are arranged in the mounting holes, the second threaded groove for inserting and threadedly connecting to the fixing screws 26 is opened on the top surface of the turret base 4, the brake gear ring 23 is vertically fixed on the bottom surface of the limit cam 29, the brake gear groove 31 that can be engaged with the brake gear ring 23 is opened on the inner peripheral wall of the dial pressing ring 25. By screwing the dial pressing ring 25 into the turret base 4, the mounting holes are aligned with the second threaded groove, the fixing screws 26 are screwed in to fix the dial pressing ring 25 onto the turret base 4, then the limit cam 29 is placed above the dial pressing ring 25 and the brake gear ring 23 is engaged with the brake gear groove 31 so that the limit cam 29 cannot be rotated. In addition, the arrangement of the dial pressing ring 25 can limit the up and down movement of the spline dial 7 to ensure the stability of the spline dial 7 during rotation.

To keep the adjusting knob 1 stable when it is not rotated, the annular limit gear groove 28 is opened on the outer peripheral wall of the turret base 4, the limit gear ring 20 engaged with the annular limit gear groove 28 is fixed on the inner peripheral wall of the adjusting knob 1, the locking screw 2 is arranged through the top surface of the adjusting knob 1 into the butt ring 14 and fits the inner wall of the butt ring 14, the top surface of the adjusting knob 1 is on the same plane as that of the locking screw 2, the connecting tube 9 is fixed on the top surface of the storing tube 8, threads are arranged on the outer peripheral wall of the connecting tube 9, the third threaded groove threadedly connected to the outer peripheral wall of the connecting tube 9 is opened on the inner peripheral wall of the locking screw 2, the annular storing groove is opened on the outer peripheral wall of the locking screw 2, the rubber clamp ring 12 is installed in the annular storing groove, two annular clamp grooves 13 distributed up and down are opened on the inner peripheral wall of the butt ring 14, and the outer side of the rubber clamp ring 12 is arranged in the annular clamp groove 13.

In normal state, the annular limit gear groove 28 is engaged with the limit gear ring 20, and the adjusting knob 1 cannot be rotated. When the adjusting knob 1 needs to be rotated, the operator can pull the handle of the adjusting knob 1 upward to disengage the annular limit gear groove 28 from the limit gear ring 20. During the process of pulling up the handle, the rubber clamp ring 12 can be moved from the annular clamp groove 13 located above it to the annular clamp groove 13 located below it, so as to continue to limit the adjusting knob 1 without affecting its rotation. It should be noted that, during the process of pulling up the handle, the butt gear ring 15 is still engaged with the annular gear groove 16, which ensures that the adjusting knob 1 can still rotate and drive the spline dial 7 to rotate after the handle is pulled up.

During the process of pulling up the handle of the adjusting knob 1, the limit cam 29 should move with the adjusting knob 1 to ensure that the position of the turn indicator 3 remains unchanged under the tension of the top reset spring 10. Therefore, the boss pressing ring 21 is threadedly connected to the inner peripheral wall of the adjusting knob 1, threads are arranged on the outer peripheral wall of the boss pressing ring 21, the fourth threaded groove threadedly connected to the outer peripheral wall of the boss pressing ring 21 is opened on the inner peripheral wall of the adjusting knob 1, the annular limit groove is opened on the outer peripheral wall of the limit cam 29, the boss pressing ring 21 is arranged in the annular limit groove and fits the gap thereof, and the annular limit groove extends to the bottom surface of the limit cam 29. When pulling up the handle of the adjusting knob 1, the boss pressing ring 21 can be moved upward together, and the limit cam 29 can be moved upward with it because the boss pressing ring 21 is arranged in the annular limit groove, which ensures that the position of the turn indicator 3 remains unchanged under the tension of the top reset spring 10. It should be noted that, when the limit cam 29 moves upward with the adjusting knob 1, the brake gear ring 23 under the limit cam 29 is still engaged with the brake gear groove 31 on the inner peripheral wall of the dial pressing ring 25, which ensures that the limit cam 29 cannot be rotated and is fixed with the turret base 4.

The working principle of the above embodiment is as follows:

The handle of the adjusting knob 1 is pulled up to disengage the annular limit gear groove 28 from the limit gear ring 20. During the process of pulling the handle up, the rubber clamp ring 12 can be moved from the annular clamp groove 13 located above it to the annular clamp groove 13 located below it. Then, the adjusting knob 1 is rotated and drives the spline dial 7 to rotate due to the engagement of the annular gear groove 16 on the outer wall of the butt ring 14 with the butt gear ring 15. When the adjusting knob 1 rotates, it drives the turn indicator to move, so that the eccentric rod 11 below it moves in the height groove 22. The limit cam 29 is fixed, so the turn indicator 3 slides along the height groove 22 of the limit cam 29. As the height groove is in spiral shape with different heights, and the compressible top reset spring 10 is applied on the turn indicator 3, so that the turn indicator 3 slides along the height groove while moves up and down relative to the adjusting knob 1. The operator can intuitively and clearly know the number of turns of rotation by observing the rise and fall of the color cap. When the operator needs to rotate the adjusting knob 1 and "zero" it, he can quickly rotate the adjusting knob 1 to match the eccentric rod 11 with the countersunk hole 30, and the eccentric rod 11 can be inserted into the countersunk hole 30 under the tension of the top reset spring 10, then the operator can get a perceptible hand feeling for quickly rotating the adjusting knob 1 and "zeroing" it.

It should also be noted that in this document, relational terms such as first and second are merely used to distinguish one entity or operation from another, and do not necessarily require or imply that there is any such actual relationship or sequence among these entities or operations. Furthermore, a term "include", "contain", or any other variation thereof is intended to cover non-exclusive inclusion, so that a process, method, article, or device including a series of elements includes not only those elements, but other elements that are not explicitly listed or elements inherent to such process, method, article, or device. Without more limitations, an element limited by a statement "includes a . . . " does not preclude the presence of additional identical elements in the process, method, article, or device including the elements.

While the embodiments of the present disclosure have been shown and described herein, it will be obvious to those of ordinary skill in the art that numerous changes, modifications, substitutions, and variations can be made to these embodiments without departing from the principle and purpose of the present disclosure, and the scope of the present disclosure is defined by the claims and their equivalents.

What is claimed is:

1. A fast zero adjusting turret for rifle scope, comprising:

a turret base (4) fixed on the scope, a rotatable adjusting knob (1) movably installed on the turret base (4), a central tube (5) vertically penetrating the middle of the bottom surface of the turret base (4), and a spline screw (6) that can linearly move up and down the central axis of the central tube (5);

wherein a spline dial (7) that can rotate with the adjusting knob (1) is arranged therein, a storing tube (8) connected to the spline screw (6) protrudes upward from the top surface of the spline dial (7), and threads connected to the spline screw (6) are arranged on the inner peripheral wall of the central tube (5);

a limit cam (29) fixed relatively to the turret base (4) and located above the spline dial (7) is further arranged inside the turret base (4), a height groove (22) is opened on the top surface of the limit cam (29), the height groove (22) is in spiral shape with multiple spiral turns, and the height of the height groove (22) with multiple spiral turns is decreased by an equal amount from inside to outside; a countersunk hole (30) opened on the limit cam (29) is connected to the bottom surface at the inner end of the height groove (22), an eccentric float is adhered to the top surface of the limit cam (29), the top end of which penetrates and extends to the top surface of the adjusting knob (1), a top reset spring (10) is movably installed on the eccentric float, on the bottom surface with eccentricity of which an eccentric rod (11) extending its bottom end to the height groove (22) and arranged in the countersunk hole (30) is vertically fixed.

2. The fast zero adjusting turret for rifle scope according to claim 1, wherein the bottom of the eccentric rod (11) is in arc shape and arranged in the countersunk hole (30), a color cap is fixed on the top of the eccentric float; when the eccentric rod (11) is arranged in the countersunk hole (30), the top surface of the color cap is on the same plane as that of the adjusting knob (1).

3. The fast zero adjusting turret for rifle scope according to claim 2, wherein a butt gear ring (15) is vertically fixed on the top surface of the spline dial (7), a butt ring (14) is vertically fixed on the inner top wall of the adjusting knob (1), and an annular gear groove (16) engaged with the butt gear ring (15) is opened on the outer peripheral wall of the butt ring (14).

4. The fast zero adjusting turret for rifle scope according to claim 3, wherein a cylindrical groove (17) is opened on the outer peripheral wall of the spline dial (7), the cylindrical groove (17) is in T shape, in which an abutting part (18) that can linearly move along its central axis is arranged; the abutting part (18) comprises a slender rod, a thick rod and an abutting head; the abutting head is fixed in T shape at one end of the thick rod and inserted into the T-shaped cylindrical groove (17); a slender rod located in the cylindrical groove (17) is fixed at the other end of the thick rod, a bottom reset spring (19) is movably installed on the slender rod, the outer wall of the thick rod fits the inner wall of the cylindrical groove (17), an annular abutting gear groove (24) is opened on the inner peripheral wall of the turret base (4), one side of the abutting head away from the thick rod is in conical shape, and the conical portion of the abutting head is arranged in the annular abutting gear groove (24).

5. The fast zero adjusting turret for rifle scope according to claim 2, wherein a dial pressing ring (25) is arranged between the limit cam (29) and the inner wall of the turret base (4), a mounting ring (27) is fixed on the outer peripheral wall and close to the top surface of the dial pressing ring (25), threads are arranged on the outer peripheral wall of the dial pressing ring (25), a first threaded groove threadedly connected to the outer peripheral wall of the dial pressing ring (25) is opened on the inner peripheral wall of the turret base (4), a plurality of mounting holes are opened on the mounting ring (27), fixing screws (26) that can be screwed through the bottom end of the mounting holes and extended into the dial pressing ring (25) are arranged in the mounting holes, a second threaded groove for inserting and threadedly connecting to the fixing screws (26) is opened on the top surface of the turret base (4), a brake gear ring (23) is vertically fixed on the bottom surface of the limit cam (29), and a brake gear groove (31) that can be engaged with the brake gear ring (23) is opened on the inner peripheral wall of the dial pressing ring (25).

6. The fast zero adjusting turret for rifle scope according to claim 2, wherein an annular limit gear groove (28) is opened on the outer peripheral wall of the turret base (4), and a limit gear ring (20) engaged with the annular limit gear groove (28) is fixed on the inner peripheral wall of the adjusting knob (1).

7. The fast zero adjusting turret for rifle scope according to claim 6, wherein a locking screw (2) is arranged through the top surface of the adjusting knob (1) into the butt ring (14) and fits the inner wall of the butt ring (14), the top surface of the adjusting knob (1) is on the same plane as that of the locking screw (2), a connecting tube (9) is fixed on the top surface of the storing tube (8), threads are arranged on the outer peripheral wall of the connecting tube (9), a third threaded groove threadedly connected to the outer peripheral wall of the connecting tube (9) is opened on the inner peripheral wall of the locking screw (2), an annular storing groove is opened on the outer peripheral wall of the locking screw (2), a rubber clamp ring (12) is installed in the annular storing groove, two annular grooves (13) distributed up and down are opened on the inner peripheral wall of the butt ring (14), and the outer side of the rubber clamp ring (12) is arranged in the annular clamp groove (13).

8. The fast zero adjusting turret for rifle scope according to claim 7, wherein a boss pressing ring (21) is threadedly connected to the inner peripheral wall of the adjusting knob (1), threads are arranged on the outer peripheral wall of the boss pressing ring (21), a fourth threaded groove threadedly connected to the outer peripheral wall of the boss pressing ring (21) is opened on the inner peripheral wall of the adjusting knob (1), an annular limit groove is opened on the outer peripheral wall of the limit cam (29), the boss pressing ring (21) is arranged in the annular limit groove and fits the gap thereof, and the annular limit groove extends to the bottom surface of the limit cam (29).

* * * * *